US007044047B1

(12) United States Patent
Bennett et al.

(10) Patent No.: US 7,044,047 B1
(45) Date of Patent: May 16, 2006

(54) CYLINDER MOUNTED STROKE CONTROL

(75) Inventors: Robert Edwin Bennett, Geneseo, IL (US); William Douglas Graham, East Moline, IL (US); Kevin William Hoehn, Bettendorf, IA (US)

(73) Assignee: Deere & Company, Moline, IL (US)

( * ) Notice: Subject to any disclaimer, the term of this patent is extended or adjusted under 35 U.S.C. 154(b) by 14 days.

(21) Appl. No.: 10/978,047

(22) Filed: Oct. 29, 2004

(51) Int. Cl.
*F15B 15/24* (2006.01)

(52) U.S. Cl. ..... 92/13.4; 92/23

(58) Field of Classification Search ..... 92/13, 92/13.4, 13.7, 23
See application file for complete search history.

(56) References Cited

U.S. PATENT DOCUMENTS 3,730,059 A * 5/1973 Nebout ..... 92/140
4,373,851 A * 2/1983 Confoey ..... 92/23
5,988,293 A * 11/1999 Brueggen et al. ..... 172/414
6,520,067 B1 * 2/2003 Hunt et al. ..... 92/23

* cited by examiner

*Primary Examiner*—Thomas E. Lazo

(57) ABSTRACT

A series of thin shims with concave profiles matching the cylinder rod is supported from the cylinder. A carrier mechanism attached to either the rod end or cylinder barrel supports a plurality of shims that can be pivoted between storage positions and stop positions. A pivoting and spring loaded latching arm works in conjunction with notches on the shim profile to lock individual shims in either the working or the storage position. Multiple shim stack operating ranges are provided by insertion of thicker shims between the main shim pack and the mating part. The mating part can be a cylinder rod end or cylinder rod guide, depending upon the shim pack carrier mechanism.

18 Claims, 3 Drawing Sheets

CYLINDER MOUNTED STROKE CONTROL

FIELD OF THE INVENTION

The present invention relates generally to hydraulic cylinders, and more specifically to mechanical devices for controlling cylinder rod retraction.

BACKGROUND OF THE INVENTION

Hydraulic cylinders are frequently used to control transport wheel structure position for seeding and tillage equipment machine frames. Typically, the cylinders are at full extension at maximum frame height and at full retraction at minimum frame height. At full and partial retraction, frame mounted tillage or seeding devices are engaged with the soil. Precise and repeatable control of cylinder length is required to maintain desired soil engagement depth. Other agricultural implements and other cylinder operated devices have similar hydraulic cylinder stroke control requirements.

Available structures for setting hydraulic cylinder stroke length include valves that control the amount of hydraulic fluid within the cylinder. Hydraulic valve activation variations or hydraulic seal leakage adversely affects precision and repeatability of such structures.

Mechanical stops placed on the linkages between the hydraulic cylinders and the wheel structure are also used to control frame height. Such a linkage arrangement is shown, for example, in U.S. Pat. No. 5,988,293. The increased loads that must be transmitted through the linkage increase the strength requirements of the linkage.

Other mechanical devices include screw type stops or removable devices of multiple thickness selectively clipped over the cylinder rod are also commonly available. Clip on devices lack preciseness and easy selectability of operating position and can be easily lost or misplaced.

SUMMARY OF THE INVENTION

A series of thin shims with concave profiles matching the cylinder rod is supported from the cylinder. A carrier mechanism attached to either the rod end or cylinder barrel supports a plurality of shims that can be pivoted between storage positions and stop positions. A selected number of the shims are positioned in line between the cylinder rod end and the cylinder rod guide in the stop positions to control the amount of cylinder retraction. The individual shims rotate between the positions on a pivot shaft parallel to the hydraulic cylinder centerline. A pivoting and spring loaded latching arm works in conjunction with notches on the shim profile to lock individual shims in either the working or the storage position. Multiple shim stack operating ranges are provided by insertion of thicker shims between the main shim pack and the mating part. The mating part can be a cylinder rod end or cylinder rod guide, depending upon the shim pack carrier mechanism. The thicker fixed shim is held in place by bolts or other suitable connecting devices.

The described shim pack provides more precise, repeatable and constant hydraulic cylinder length control compared to systems which trap hydraulic fluid within the cylinder. Vulnerability to hydraulic valve activation variations or hydraulic seal leakage are eliminated. The described shim pack structure provides more precise and more easily selected cylinder control compared to devices which clip on the cylinder rod. The shim pack may have thin shims of equal thickness to facilitate a simple counting process to determine total length. Alternating shim shapes aid the counting and adjustment process, particularly when the operator is wearing gloves. The fixed shim provides convenient range shifting with less weight and complexity and more flexibility than multiple thin shims.

These and other objects, features and advantages of the present invention will become apparent to one skilled in the art from the following description.

The above-described cylinder mounted shim pack has reduced size, cost and strength requirements compared to mechanical stops mounted to the linkage between a hydraulic cylinder and wheel structure. The cylinder mounted shim pack confines hydraulically generated retraction loads within the cylinder and shim pack assembly rather than transmitting those loads through the linkage, thereby reducing the strength requirements of the linkage. The described cylinder mounted shim pack facilitates more repeated and consistent adjustments compared to cylinder mounted screw-type stops. A simple count of engaged shims provides quick choice and determination of adjustment setting. The shim pack construction also avoids corrosion problems which may occur in a threaded joint, and the alternating shim shapes create finger holds for easier separation of adjoining shims while moving shims between operating and storage positions. The alternating shims shapes also facilitate the process of counting shims for precise and repeatable adjustments.

DESCRIPTION OF THE PREFERRED EMBODIMENT

Figure 1:
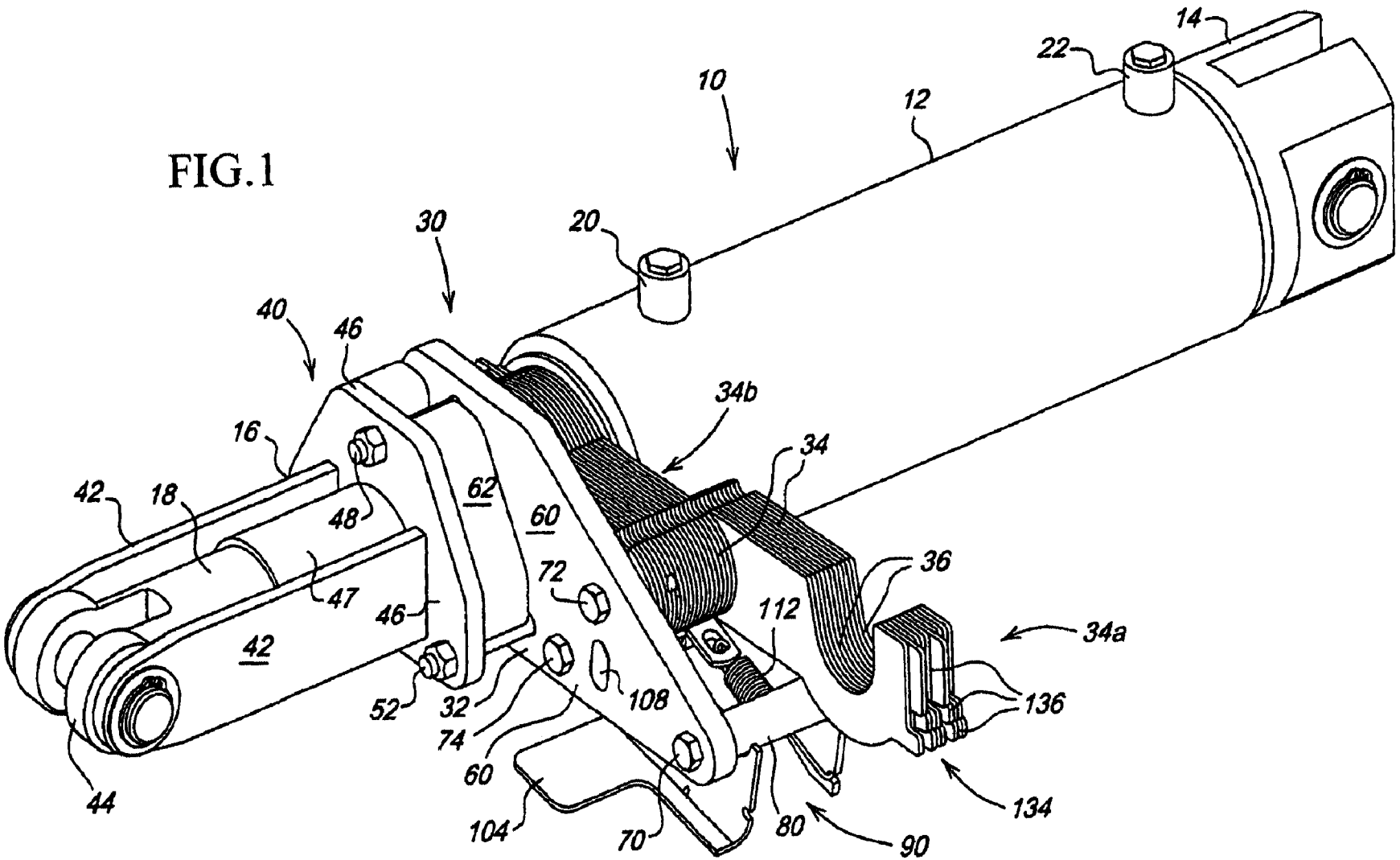
FIG. 1 is a perspective view of a hydraulic cylinder with an attached shim pack.

Referring now to the drawings, a hydraulic cylinder 10 includes a barrel 12 with a base end 14 and a rod end 16. A cylinder rod 18 is connected to a conventional piston (not shown) within the barrel 12. Rod and base end ports 20 and 22 connected to a source of hydraulic fluid under pressure open into the barrel 12 on opposite sides of the piston. Pressurizing the port 20 relative to the port 22 retracts the rod 18, and pressurizing the port 22 relative to the port 20 extends the rod 18.

To adjust cylinder rod retraction for implement height control or other function, shim pack structure 30 is connected to the cylinder 10. The structure 30 includes a carrier 32 pivotally supporting a plurality of movable shims 34 having notches 36 conforming generally to the rod 18. The shims 34 are movable about 180 degrees between storage positions (34*a*) offset from the rod and stop positions (34*b*) wherein the notches 36 generally embrace the rod 18. The shims in the stop positions 34*b* provide a mechanical stop between end 12*e* of the barrel 12 and end 38 of the rod 18. The amount of retraction of the cylinder rod 18 is dependent on the number of shims 34 rotated to the stop positions 34*b*. As shown, the carrier 32 is connected to the rod end 38 for movement with the rod 18. However, the carrier 32 may also be attached to the barrel 12 if desired.

A rod end bracket shown generally at 40 includes side straps 42 connected to rod end attachment portion 44 and extending to a transverse plate 46 on a rod sleeve 47. Mounting bolts 48, 50 and 52 extend through the plate 46 and first carrier plate 60 to sandwich a range adjusting fixed shim 62 between the plates 46 and 60. A plurality of fixed shims 62 of varying thicknesses typically greater than the combined thickness of a plurality of the movable shims 34 can be made available to the operator, and the thickness of the fixed shim 62 chosen defines the adjustment range provided by the movable shims 34.

Bolts 70, 72 and 74 extending through the plate 60, through apertures in a second carrier plate 76, and through spacers 80, 82 and 84, respectively, secure the carrier plate 76 in parallel offset relationship to the plate 60 on opposite sides of the shims 34. Ends of the shims 34 opposite the notched ends include apertures received over the spacer 82 for pivoting of the shims about an axis parallel to but offset from the axis of the rod 18. The shims 34 in the storage positions 34*a* abut the spacer 80. The notches 36 of the shims 34 in the stop positions 34*b* extend completely around the rod 18 so that the shims 34*b*, the plates 46 and 60 and the fixed shim 62 form a firm stop for the rod 18 upon retraction of the cylinder 10.

Figure 2:
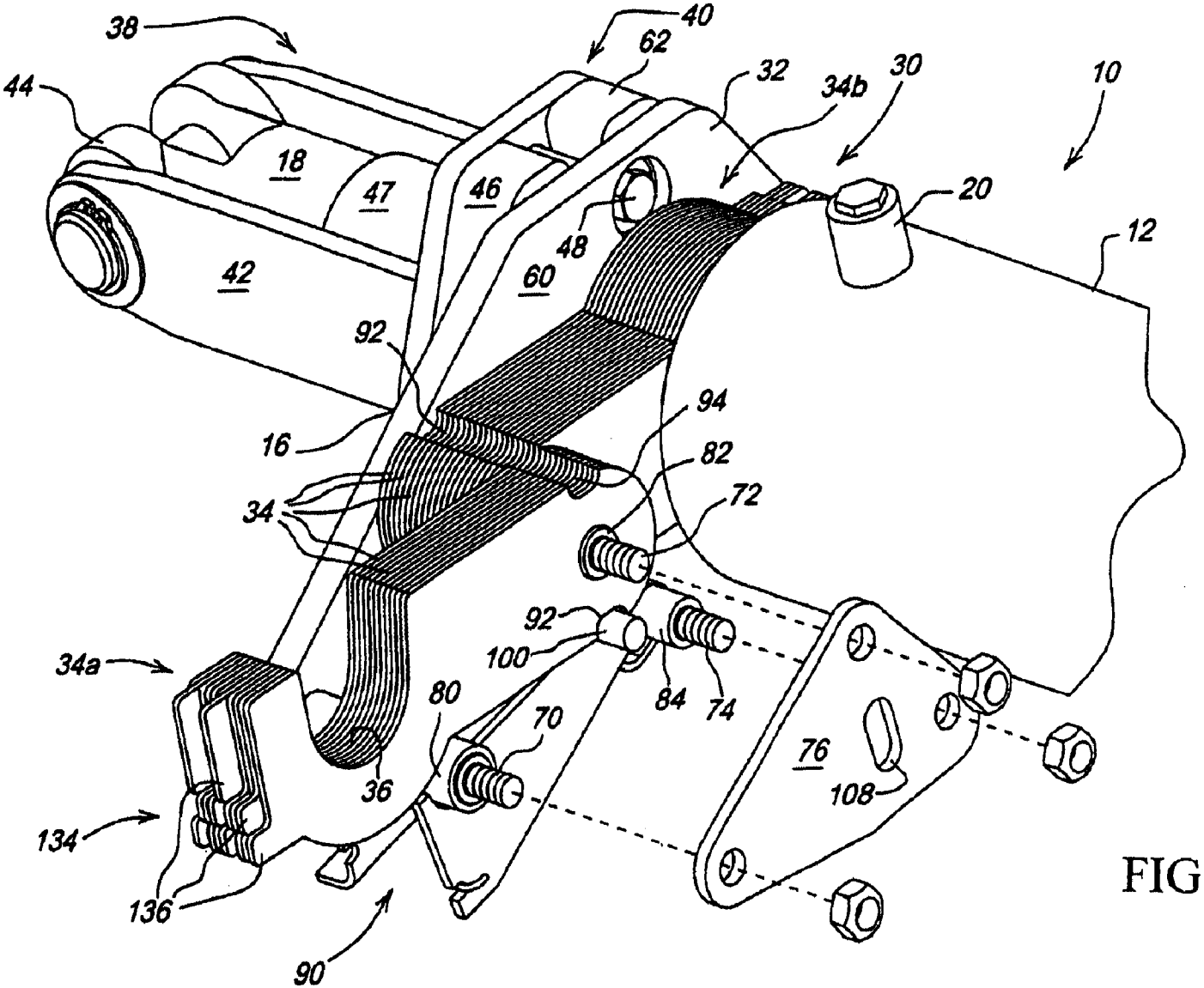
FIG. 2 is a partially exploded enlarged view of the rod end of FIG. 1.
Figure 3:
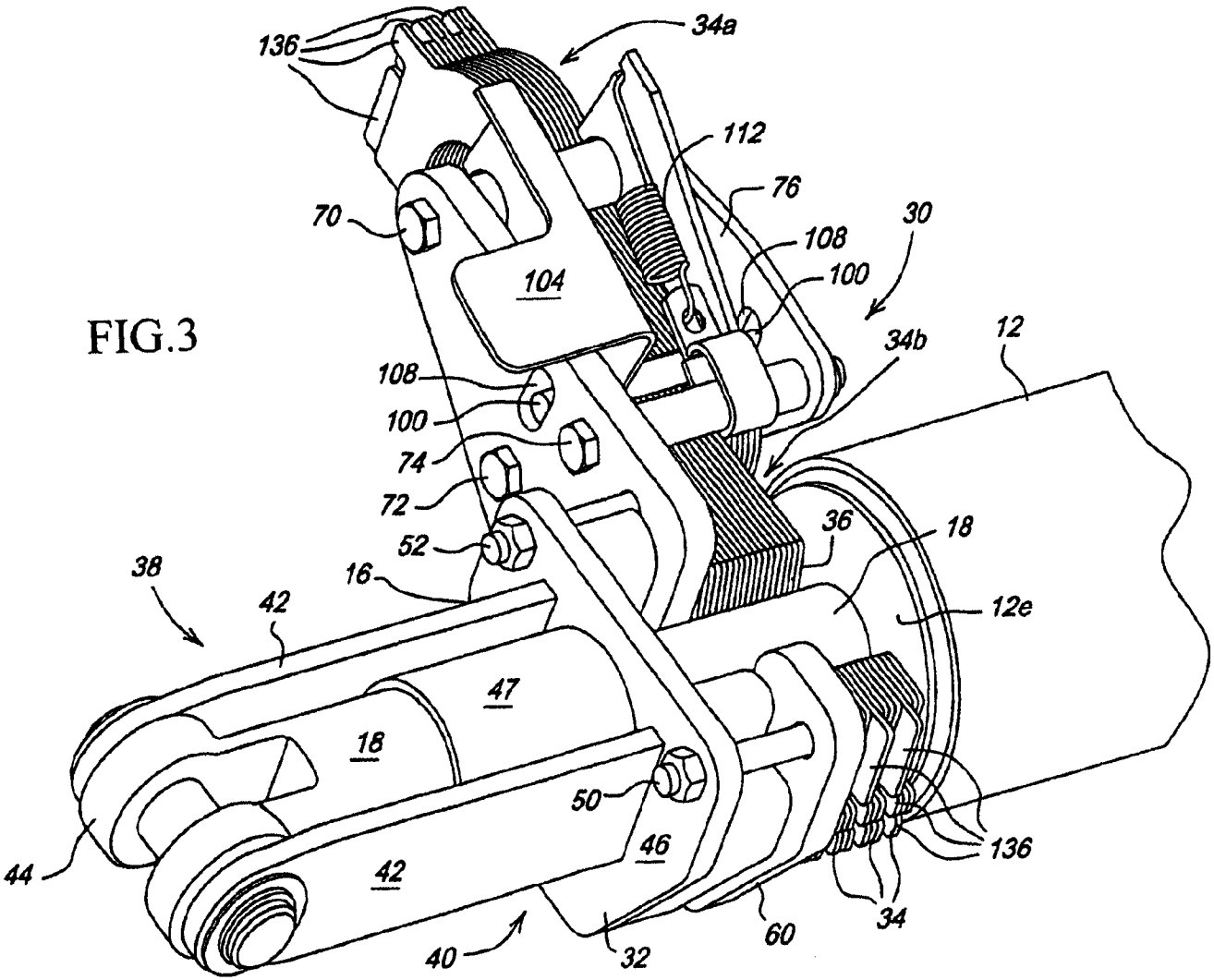
FIG. 3 is an opposite side and enlarged perspective view of the rod end shown in FIG. 2.

Shim latching structure 90 is also connected between the plates 60 and 76 to selectively secure the shims 34 in both the storage and stop positions. The shims 34 have a first set of notches 92 and a second set of notches 94 offset about 180 degrees on the opposite side of the bolt 72. The latching structure 90 includes a spring-biased shaft or latch 100 which engages the notches 92 and 94 aligned on the underside of the shims (as shown in FIGS. 1 and 2) to secure both the shims 34*a* and 34*b* in the respective storage and stop positions. Latch handle structure 104 is provided to urge the latch 100 downwardly in guide slots 108 away from the aligned underside notches to permit the shims to be rotated. Spring structure 112 biases the handle structure 104 and latch 100 about the axis of the bolt 70 towards a shim locking position.

The movable shims 34 have varying configurations at locations 134 to facilitate access to the shims for movement of the shims between positions. The varying shim configuration shown defines offset tabs indicated at 136 that help the operator get an accurate count of the shims 34*b* for precise depth adjustment. The configuration also facilitates separation and movement of the shims between the positions.

Having described the preferred embodiment, it will become apparent that various modifications can be made without departing from the scope of the invention as defined in the accompanying claims.

The invention claimed is:

1. Cylinder structure comprising a cylinder having a barrel, an extendable and retractable cylinder rod projecting from the barrel, shim structure connected to the cylinder adjacent the rod, the shim structure including a carrier, a plurality of movable shims connected to the carrier and including a shape conforming generally to the rod, the shims movable between storage positions offset from the rod and stop positions generally embracing the rod, the shims in the stop positions providing a mechanical stop between the barrel and the rod and limiting retraction of cylinder rod relative to the barrel to define a rod stop position, the rod stop position dependent on the number of shims rotated to the stop positions.

2. The cylinder structure as set forth in claim 1 wherein the shim structure is connected to the rod for movement with the rod as the rod extends and retracts.

3. The cylinder structure as set forth in claim 1 wherein the rod includes a rod end bracket, the rod end bracket supporting a range adjusting fixed shim for varying an adjustment range provided by the movable shims.

4. The cylinder structure as set forth in claim 3 wherein the movable shims are pivotally connected to the rod end bracket.

5. The cylinder structure as set forth in claim 4 including a shim lock connected to the rod end bracket securing the movable shims in selected stop and storage positions.

6. The cylinder structure as set forth in claim 1 wherein the movable shims have varying configurations to facilitate access to the shims for movement of the shims between positions.

7. The cylinder structure as set forth in claim 1 including a shim lock connected to the cylinder and biased towards the shims to secure the shims in selected stop and storage positions.

8. The cylinder structure as set forth in claim 7 wherein the shim lock includes a spring loaded latch movable between locking and release positions, and the shims include first and second notches, wherein the first notches are engaged by the latch in the locking position when the shims are in the storage position and the second notches are engaged by the latch when the shims are in the stop positions.

9. The cylinder structure as set forth in claim 1 wherein the movable shims are pivotally connected to the carrier for rotation approximately 180 degrees about an axis parallel to the cylinder rod, the movable shims having an arcuate notch engaging the cylinder rod when the shims are in the stop position.

10. The cylinder structure as set forth in claim 9 wherein the movable shims include adjacent shims of differing shape to facilitate separation and movement of the shims between the positions.

11. Cylinder structure comprising a cylinder having a barrel, an extendable and retractable cylinder rod projecting from the barrel, shim structure connected to the cylinder adjacent the rod, the shim structure including a carrier, a plurality of movable shims connected to the carrier and including a shape conforming generally to the rod, the shims movable between storage positions offset from the rod and stop positions generally embracing the rod, the shims in the stop positions providing a mechanical stop between the barrel and the rod and limiting retraction of cylinder rod relative to the barrel to define a rod stop position, the rod stop position dependent on the number of shims rotated to the stop positions, and a bracket supporting a fixed shim between the movable shims and the cylinder, the fixed shim defining a range of adjustment provided by the movable shims.

12. The cylinder structure as set forth in claim 11 wherein the fixed shim is replaceable with alternating fixed shims of differing thicknesses to change the defined range of adjustment.

13. The cylinder structure of claim 11 wherein the carrier includes a latch biased into engagement with the moveable shims and securing the shims in both the storage and stop positions.

14. The cylinder structure as set forth in claim 11 wherein the movable shims include adjacent shims with offset edges to facilitate separation and movement of the shims between the storage and stop positions.

15. Cylinder structure comprising a cylinder having a barrel, an extendable and retractable cylinder rod having a rod end projecting from the barrel, a carrier connected to the rod end for movement therewith, shim structure connected to the carrier adjacent the rod, a plurality of movable shims connected to the carrier and movable between storage positions offset from the rod and stop positions generally embracing the rod, the shims in the stop positions providing a mechanical stop between the barrel and the rod and limiting retraction of cylinder rod relative to the barrel to define a rod stop position, the rod stop position dependent on the number of shims rotated to the stop positions.

16. The cylinder structure as set forth in claim 15 including a fixed shim connected to the carrier and having a thickness greater than the thickness of individual movable shims and defining a range of adjustment of the stop position.

17. The cylinder structure as set forth in claim 16 wherein the fixed shim is replaceable with alternating fixed shims of differing thicknesses to change the defined range of adjustment.

18. The cylinder structure as set forth in claim 15 wherein the movable shims include adjacent shims with offset edges to facilitate separation and movement of the shims between the storage and stop positions.

* * * * *